US010821732B2

(12) United States Patent
Nishida

(10) Patent No.: US 10,821,732 B2
(45) Date of Patent: Nov. 3, 2020

(54) INKJET PRINTER, CONTROL METHOD OF INKJET PRINTER, AND NON-TRANSITORY COMPUTER-READABLE MEDIUM STORING COMPUTER-READABLE INSTRUCTIONS

(71) Applicant: BROTHER KOGYO KABUSHIKI KAISHA, Nagoya-shi, Aichi-ken (JP)

(72) Inventor: Katsunori Nishida, Nagoya (JP)

(73) Assignee: BROTHER KOGYO KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/232,641

(22) Filed: Dec. 26, 2018

(65) Prior Publication Data

US 2019/0193404 A1 Jun. 27, 2019

(30) Foreign Application Priority Data

Dec. 27, 2017 (JP) ..... 2017-252031

(51) Int. Cl.
*B41J 2/165* (2006.01)
*B41J 2/175* (2006.01)
(Continued)

(52) U.S. Cl.
CPC ..... *B41J 2/16523* (2013.01); *B41J 2/1652* (2013.01); *B41J 2/16505* (2013.01);
(Continued)

(58) Field of Classification Search
CPC ..... B41J 2/16523; B41J 2/16505; B41J 2/16508; B41J 2/1652; B41J 2/16532;
(Continued)

(56) References Cited

U.S. PATENT DOCUMENTS 7,621,626 B2 * 11/2009 Umeda ..... B41J 2/175 347/28
9,878,542 B2 * 1/2018 Mizutani ..... B41J 2/16508
(Continued)

FOREIGN PATENT DOCUMENTS

JP H10-202909 A 8/1998
JP 2015-085660 A 5/2015
JP 2017-087708 A 5/2017

OTHER PUBLICATIONS

Extended European search report dated May 24, 2019 in connection with European Patent Application No. 18215703.2. (8 pages).

*Primary Examiner* — Thinh H Nguyen
(74) *Attorney, Agent, or Firm* — K&L Gates LLP

(57) ABSTRACT

The inkjet printer includes a head, a circulation flow path, a cap, a first pump, and a control unit. The head has a nozzle surface having nozzles to eject ink. The circulation flow path circulates ink. The cap can contact the nozzle surface. The first pump is connected to an exhaust hole formed in the cap. In a soaking processing, the processor drives the first pump and causes the nozzle surface to be soaked in liquid, in a capping state in which the cap is in contact with the nozzle surface. In a circulation processing, the processor causes the ink to circulate in the circulation flow path in a state in which the nozzle surface is soaked in the liquid, after the soaking processing.

11 Claims, 12 Drawing Sheets

(51) Int. Cl.

| | |
|---|---|
| ***B41J 2/17*** | (2006.01) |
| ***B41J 29/02*** | (2006.01) |
| ***B41J 2/18*** | (2006.01) |
| ***B41J 29/38*** | (2006.01) |

(52) U.S. Cl.
CPC ..... *B41J 2/16508* (2013.01); *B41J 2/16532* (2013.01); *B41J 2/16535* (2013.01); *B41J 2/16552* (2013.01); *B41J 2/175* (2013.01); *B41J 2/1707* (2013.01); *B41J 2/17509* (2013.01); *B41J 2/17566* (2013.01); *B41J 2/17596* (2013.01); *B41J 2/18* (2013.01); *B41J 29/02* (2013.01); *B41J 29/38* (2013.01); *B41J 2002/16594* (2013.01); *B41J 2202/12* (2013.01)

(58) Field of Classification Search
CPC .. B41J 2/16535; B41J 2/16552; B41J 2/1707; B41J 2/175; B41J 2/17509; B41J 2/17566; B41J 2/17596; B41J 2/18; B41J 29/02; B41J 29/38; B41J 2202/16594; B41J 2202/12
See application file for complete search history.

(56) References Cited

U.S. PATENT DOCUMENTS

| | | | |
|---|---|---|---|
| 2003/0189616 | A1 | 10/2003 | Yamada |
| 2017/0113465 | A1 | 4/2017 | Nakamura et al. |
| 2017/0120602 | A1 | 5/2017 | Nakai et al. |

* cited by examiner

INKJET PRINTER, CONTROL METHOD OF INKJET PRINTER, AND NON-TRANSITORY COMPUTER-READABLE MEDIUM STORING COMPUTER-READABLE INSTRUCTIONS

CROSS-REFERENCE TO RELATED APPLICATION

This application claims priority to Japanese Patent Application No. 2017-252031 filed Dec. 27, 2017. The contents of the foregoing application are hereby incorporated herein by reference.

BACKGROUND

The present disclosure relates to an inkjet printer, a control method of an inkjet printer, and a non-transitory computer-readable medium storing computer-readable instructions.

An inkjet printer is known that circulates ink in order to remove air bubbles and eliminate sedimentation of ink components in a head or in a flow path from an ink storage portion to the head. For example, Japanese Laid-Open Patent Publication No. 2017-87708 discloses an inkjet printer including a plurality of pressure generation chambers, a supply liquid chamber, a plurality of supply paths, a circulation liquid chamber, a plurality of circulation paths, and a circulation tank. The pressure generation chambers respectively lead to a plurality of nozzles and apply pressure to the ink. The supply liquid chamber stores the ink to be supplied to the pressure generation chambers. The supply paths supply the ink from the supply liquid chamber to the presser generation chambers. The circulation paths cause the pressure generation chambers and the circulation liquid chamber to be communicated with each other, and cause the ink in the pressure generation chambers to be stored in the circulation liquid chamber. The ink in the circulation liquid chamber is fed to the circulation tank. Thus, together with the air bubbles, the ink is collected from the circulation liquid chamber to the circulation tank via the circulation paths. Further, the sedimentation of the ink components is eliminated by the circulation of the ink.

SUMMARY

In the inkjet printer described in the above-described publication, when a circulation speed of the ink is increased in order to further remove the air bubbles and eliminate the sedimentation of the ink components, there is a possibility that the nozzle meniscus may be damaged. In this case, there is a possibility that the air bubbles may be introduced from the nozzles to the head or the ink may flow out from the nozzles.

Embodiments of the broad principles derived herein provide an inkjet printer, a control method of an inkjet printer, and a non-transitory computer-readable medium storing computer-readable instructions which reduce a possibility of air bubbles being introduced from nozzles into a head when an ink is circulated, or a possibility of flow-out of the ink from the nozzles.

The embodiments herein provide an inkjet printer including: a head provided with a nozzle surface having nozzles configured to eject an ink; a circulation flow path configured to circulate the ink; a cap capable of coming into contact with the nozzle surface; a first pump connected to an exhaust hole formed in the cap; a processor; and a memory storing computer-readable instructions which, when executed by the processor, perform processes including: a soaking processing that drives the first pump and causes the nozzle surface to be soaked in liquid, in a capping state in which the cap is in contact with the nozzle surface; and a circulation processing that causes the ink to circulate in the circulation flow path in a state in which the nozzle surface is soaked in the liquid, after the soaking processing.

The embodiments herein also provide a control method of an inkjet printer that includes a head provided with a nozzle surface having inkjet nozzles configured to eject an ink, a circulation flow path configured to circulate the ink, a cap capable of coming into contact with the nozzle surface, and a first pump connected to an exhaust hole formed in the cap. The control method includes: a soaking step of driving the first pump and causing the nozzle surface to be soaked in liquid, in a capping state in which the cap is in contact with the nozzle surface; and a circulation step of causing the ink to circulate in the circulation flow path in a state in which the nozzle surface is soaked in the liquid, after the soaking step.

The embodiments herein also provide a non-transitory computer-readable medium storing computer-readable instructions causes a processor of an inkjet printer comprising a head provided with a nozzle surface having inkjet nozzles configured to eject an ink, a circulation flow path configured to circulate the ink, a cap capable of coming into contact with the nozzle surface, a first pump connected to an exhaust hole formed in the cap, and the processor, to perform: a soaking processing that drives the first pump and causes the nozzle surface to be soaked in liquid, in a capping state in which the cap is in contact with the nozzle surface, and a circulation processing that causes the ink to circulate in the circulation flow path in a state in which the nozzle surface is soaked in the liquid, after the soaking processing.

BRIEF DESCRIPTION OF THE DRAWINGS

Embodiments will be described below in detail with reference to the accompanying drawings in which.

DETAILED DESCRIPTION

Hereinafter, a print device 1 of a first embodiment of the present invention will be explained with reference to the drawings. An overview of the print device 1 will be explained with reference to FIG. 1. The upward direction, the downward direction, the left downward direction, the right upward direction, the right downward direction and the left upward direction in FIG. 1 respectively correspond to an upward direction, a downward direction, a front direction, a rear direction, a right direction and a left direction of the print device 1.

Figure 3:
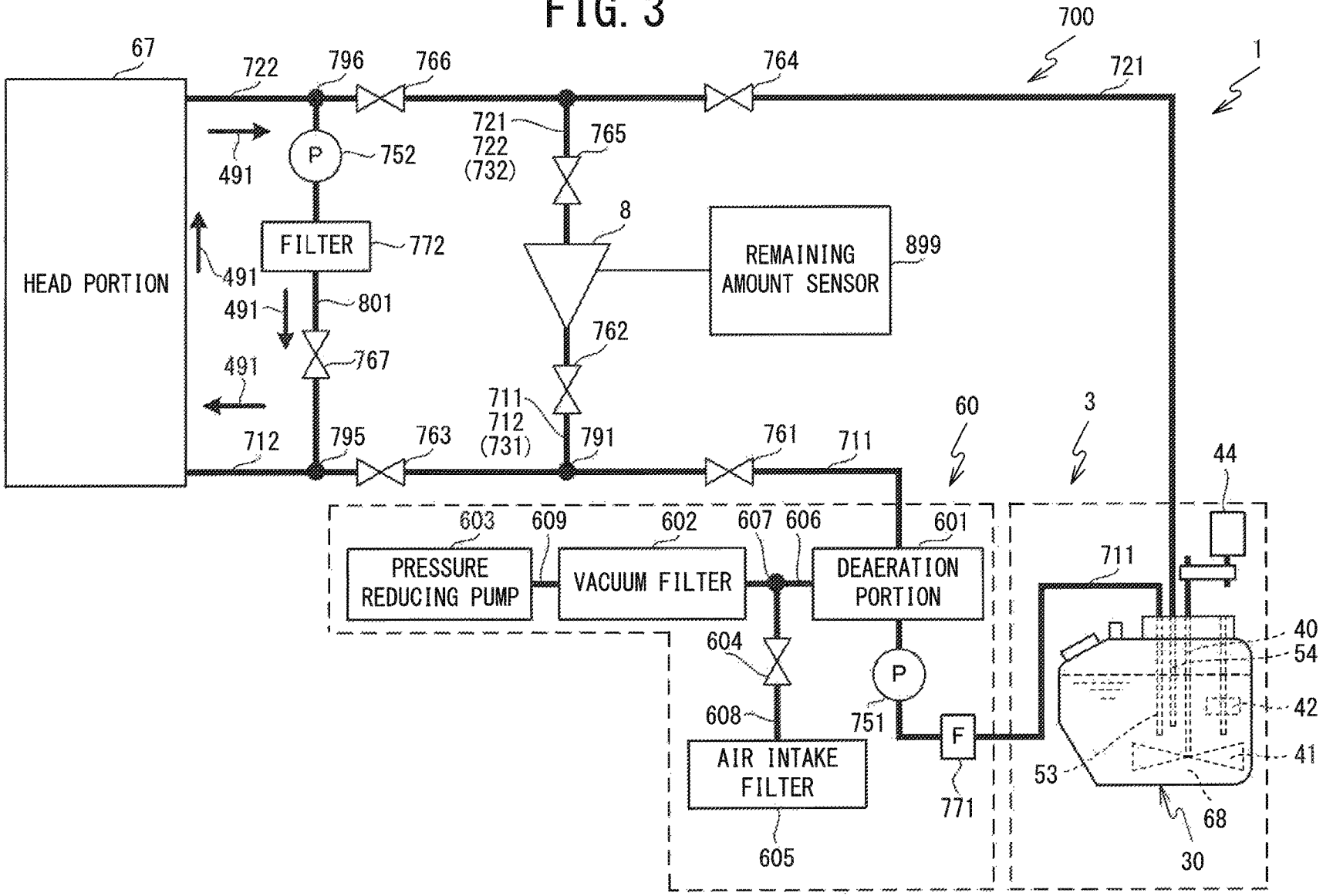
FIG. 3 is a schematic diagram showing a configuration of the print device 1.

The print device 1 is an inkjet printer that performs printing on a fabric such as a T-shirt, or a recording medium such as paper, by ejecting an ink 68 (refer to FIG. 3) from nozzles of a head portion 67 (refer to FIG. 3). The print device 1 prints a color image on the recording medium by downwardly ejecting, for example, five different types (white (W), black (K), yellow (Y), cyan (C) and magenta (M)) of the ink 68. In the following explanation, of the five types of the ink 68, the white ink 68 is referred to as white ink. When the four colors of the ink 68, i.e., the black, cyan, yellow and magenta inks, are collectively referred to, they are referred to as color inks. The white ink is an ink having higher settleability than the color inks.

Figure 1:
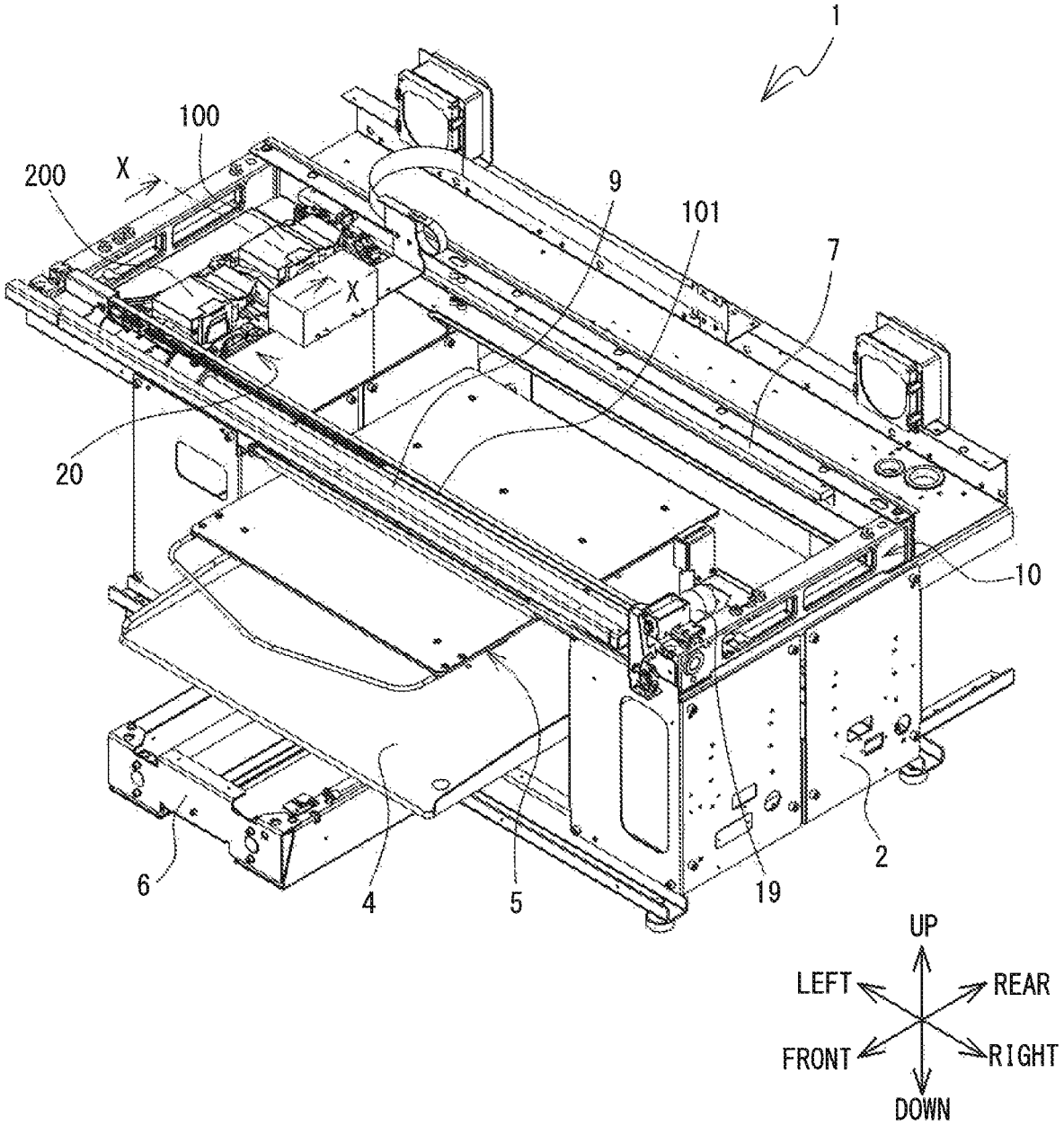
FIG. 1 is a perspective view of a print device 1.

As shown in FIG. 1, the print device 1 is provided with a housing 2, a platen drive mechanism 6, a pair of guide rails (not shown in the drawings), a platen 5, a tray 4, a frame body 10, a guide shaft 9, a rail 7, a carriage 20, head units 100 and 200, a drive belt 101 and a drive motor 19. An operation portion (not shown in the drawings) that is used to perform operations of the print device 1 is provided at a front position on the right side of the housing 2. The operation portion is operated when an operator inputs commands relating to various operations of the print device 1.

The frame body 10 has a substantially rectangular frame shape in a plan view, and is installed on an upper portion of the housing 2. The front side of the frame body 10 supports the guide shaft 9, and the rear side of the frame body 10 supports the rail 7. The guide shaft 9 extends in the left-right direction on the inside of the frame body 10. The rail 7 is disposed facing the guide shaft 9 and extends in the left-right direction.

The carriage 20 is supported such that it can be conveyed in the left-right direction along the guide shaft 9. The head units 100 and 200 are mounted on the carriage 20 such that they are aligned in the front-rear direction. The head unit 100 is positioned further to the rear than the head unit 200. The head portion 67 (refer to FIG. 2) is provided on a lower portion of each of the head units 100 and 200. The head portion 67 of the head unit 100 ejects the white ink. The head portion 67 of the head unit 200 ejects the color inks. The head portion 67 is provided with a surface having a plurality of fine nozzles (not shown in the drawings) that can eject the ink 68 downward.

As shown in FIG. 1, the drive belt 101 is stretched along the left-right direction on the inside of the frame body 10. The drive motor 19 is coupled to the carriage 20 via the drive belt 101. When the drive motor 19 drives the drive belt 101, the carriage 20 is caused to reciprocate in the left-right direction along the guide shaft 9.

The platen drive mechanism 6 is provided with the pair of guide rails (not shown in the drawings) and a platen support base (not shown in the drawings). The pair of guide rails extend in the front-rear direction on the inside of the platen drive mechanism 6, and support the platen support base such that the platen support base can move in the front-rear direction. An upper portion of the platen support base supports the platen 5. The platen 5 supports the recording medium. The tray 4 is provided below the platen 5. When the operator places a T-shirt or the like on the platen 5, the tray 4 receives a sleeve or the like of the T-shirt, and thus protects the sleeve or the like such that the sleeve or the like does not come into contact with other components inside the housing 2. The platen drive mechanism 6 is driven by a sub-scanning drive portion (not shown in the drawings), and moves the platen support base and the platen 5 along the pair of guide rails in the front-rear direction. Printing by the print device 1 on the recording medium is performed by the platen 5 conveying the recording medium in the front-rear direction (a sub-scanning direction) and the ink 68 being ejected from the head portion 67 that is reciprocating in the left-right direction (a main scanning direction).

Figure 2:
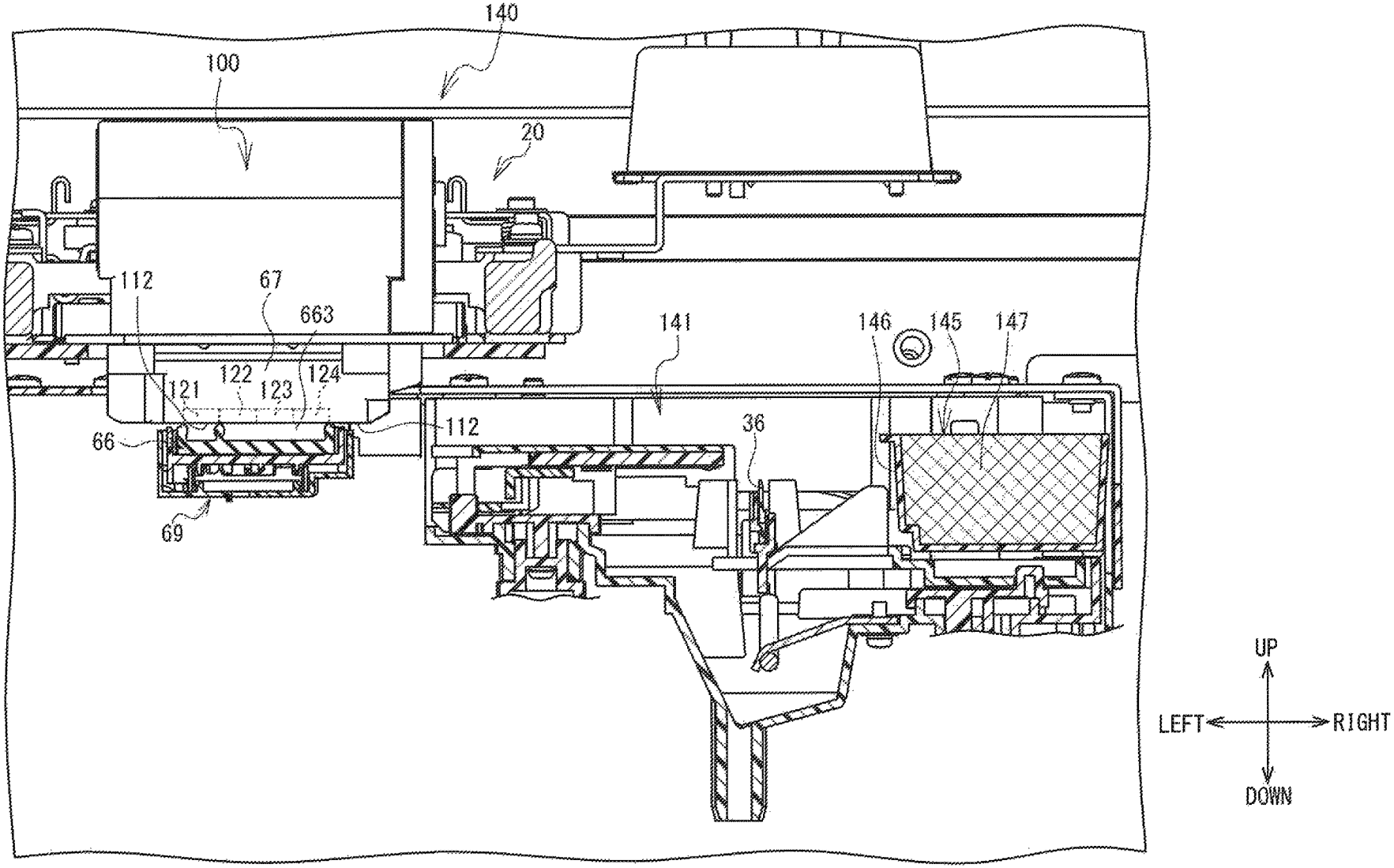
FIG. 2 is a cross-sectional view in the direction of arrows along a line X-X shown in FIG. 1, where a wiper 36 is in a wiper separation position, and a cap 66 is in a covering position.

As shown in FIG. 2, a maintenance portion 141 of the print device 1 is provided with a wiper 36, a flushing receiving portion 145, a cap 66 and a cap support portion 69. The flushing receiving portion 145 is provided on a right portion of the maintenance portion 141. The flushing receiving portion 145 is provided with a container portion 146 and an absorption body 147. The flushing receiving portion 145 receives the ink that is ejected from the head portion 67 of the head unit 100 by a flushing operation. The ink is absorbed by the absorption body 147.

As shown in FIG. 3, the wiper 36 is provided to the left of the flushing receiving portion 145 and below a nozzle surface 112 of the head unit 100. The wiper 36 can move up and down. The wiper 36 extends in the front-rear direction.

As shown in FIG. 3, the print device 1 is provided with an ink supply portion 700, a liquid storage device 3 and a deaeration module 60. The ink supply portion 700 supplies the white ink 68 to the head portion 67. The head portion 67 is provided with an inkjet head. Ink supply portions (not shown in the drawings) that supply the other four colors of the ink 68 to the head portion 67 of the head unit 200 have the same configuration as that shown in FIG. 3. The liquid storage device 3 supplies the white ink 68 to the ink supply portion 700 and stores the ink 68 that returns from the ink supply portion 700. The deaeration module 60 removes air bubbles from the ink 68 that flows through a first supply flow path 711 to be described later. A shaft 40, a first tube 53, a second tube 54 and a remaining amount sensor 42 are inserted into the inside of a main tank 30.

Ink Supply Portion 700

The ink supply portion 700 supplies the ink 68 to the head portion 67. The ink supply portion 700 is a portion through which the ink 68 circulates. The ink supply portion 700 is provided with the first supply flow path 711, a second supply flow path 712, a first circulation flow path 721, a second circulation flow path 722, a first connection flow path 731, a second connection flow path 732, a sub pouch 8, the deaeration module 60, a pump 751, electromagnetic valves 761, 762, 763, 764, 765 and 766, and a filter 771.

The sub pouch 8 has a bag shape and stores the ink 68 supplied from the main tank 30. Further, the sub pouch 8 supplies the ink 68 to the head portion 67. The head portion 67 ejects the ink 68 supplied from the sub pouch 8 and thus performs printing on a print target. A remaining amount sensor 899 is mounted on the sub pouch 8.

The first supply flow path 711, the second supply flow path 712, the first circulation flow path 721, the second circulation flow path 722, the first connection flow path 731 and the second connection flow path 732 are each formed by a hollow tube, for example. The first supply flow path 711 connects to the first tube 53 of the liquid storage device 3 and to the sub pouch 8, and is a flow path that supplies the ink 68 from the main tank 30 to the sub pouch 8.

The second supply flow path 712 connects to the sub pouch 8 and to the head portion 67, and is a flow path that supplies the ink 68 from the sub pouch 8 to the head portion 67. The first supply flow path 711 and the second supply flow path 712 converge at a first connection portion 791. The first connection flow path 731 is a flow path between the first connection portion 791 and the sub pouch 8. That is, the first connection flow path 731 is a part of the first supply flow path 711 and is also a part of the second supply flow path 712.

The first circulation flow path 721 connects to the second tube 54 of the liquid storage device 3 and to the sub pouch 8, and is a flow path to circulate the ink 68 from the sub pouch 8 to the main tank 30. The second circulation flow path 722 connects to the head portion 67 and to the sub pouch 8, and is a flow path to circulate the ink 68 from the head portion 67 to the sub pouch 8. The first circulation flow path 721 and the second circulation flow path 722 converge at a second connection portion 792. The second connection flow path 732 is a flow path between the second connection portion 792 and the sub pouch 8. That is, the second connection flow path 732 is a part of the first circulation flow path 721 and is also a part of the second circulation flow path 722.

The electromagnetic valve 761 is provided in the first supply flow path 711. The electromagnetic valve 761 is positioned closer to the sub pouch 8 than a deaeration portion 601 to be described later. The electromagnetic valve 761 is controlled by a CPU 70 (refer to FIG. 5) to be described later, and opens and closes the first supply flow path 711. The electromagnetic valve 762 is provided in the first connection flow path 731. The electromagnetic valve 762 is controlled by the CPU 70 and opens and closes the first connection flow path 731. The electromagnetic valve 763 is provided in the second supply flow path 712. The electromagnetic valve 763 is controlled by the CPU 70 and opens and closes the second supply flow path 712.

The electromagnetic valve 764 is provided in the first circulation flow path 721. The electromagnetic valve 764 is controlled by the CPU 70 and opens and closes the first circulation flow path 721. The electromagnetic valve 765 is provided in the second connection flow path 732. The electromagnetic valve 765 is controlled by the CPU 70 and opens and closes the second connection flow path 732. The electromagnetic valve 766 is provided in the second circulation flow path 722. The electromagnetic valve 766 is controlled by the CPU 70 and opens and closes the second circulation flow path 722.

The filter 771 is provided in the first supply flow path 711. The filter 771 removes foreign matter contained in the ink 68 that flows through the first supply flow path 711. The pump 751 is provided in the first supply flow path 711. The pump 751 is provided closer to the sub pouch 8 than the filter 711. The pump 51 sucks up the ink 68 from the main tank 30 and causes the ink 68 to flow to the sub pouch 8 side, which is the downstream side.

The deaeration module 60 is provided in the first supply flow path 711. The deaeration module 60 is provided with the deaeration portion 601, a vacuum filter 602, a pressure reducing pump 603, an electromagnetic valve 604, an air intake filter 605, a pathway 606, a pathway 608 and a pathway 609. The deaeration portion 601 is provided in the first supply flow path 711. The deaeration portion 601 is positioned between the pump 751 and the electromagnetic valve 761. The vacuum filter 602 is connected to the deaeration portion 601 via the pathway 606. The pathway 606 is connected to the pathway 608 at a connection portion 607. The air intake filter 605 is connected to the pathway 608. The electromagnetic valve 604 is provided in the pathway 608. The pressure reducing pump 603 is connected to the vacuum filter 602 via the pathway 609.

The pressure reducing pump 603 operates under the control of the CPU 70, and depressurizes the pathway 606 via the vacuum filter 602. Therefore, air bubbles contained in the ink 68 flowing through the deaeration portion 601 are reduced. When the pathway 606 is depressurized, the electromagnetic valve 604 is controlled by the CPU 70 and closes the pathway 608. When the pathway 606 is not depressurized, the electromagnetic valve 604 is controlled by the CPU 70 and opens the pathway 608. When the pathway 608 is opened, ambient air is supplied to the pathway 606 via the air intake filter 605 and the pathway 606. Thus, the depressurized state of the pathway 606 is released. The air intake filter 605 removes foreign matter from the ambient air flowing to the pathway 608 side.

Further, in the print device 1 shown in FIG. 3, the second supply flow path 712 and the second circulation flow path 722 are connected by a bypass flow path 801. The second supply flow path 712 is connected to the bypass flow path 801 at a third connection portion 795 that is provided between the electromagnetic valve 763 and the head portion 67. Further, the second circulation flow path 722 is connected to the bypass flow path 801 at a fourth connection portion 796 that is provided between the electromagnetic valve 766 and the head portion 67. The bypass flow path 801 is provided with an electromagnetic valve 767, a filter 772 and a pump 752, from the third connection portion 795 toward the fourth connection portion 796. The electromagnetic valve 767 opens and closes the bypass flow path 801. The filter 772 removes foreign matter contained in the ink 68 that flows through the bypass flow path 801.

Configuration of First Nozzle Portion 167 and Second Nozzle Portion 267

Figure 4:
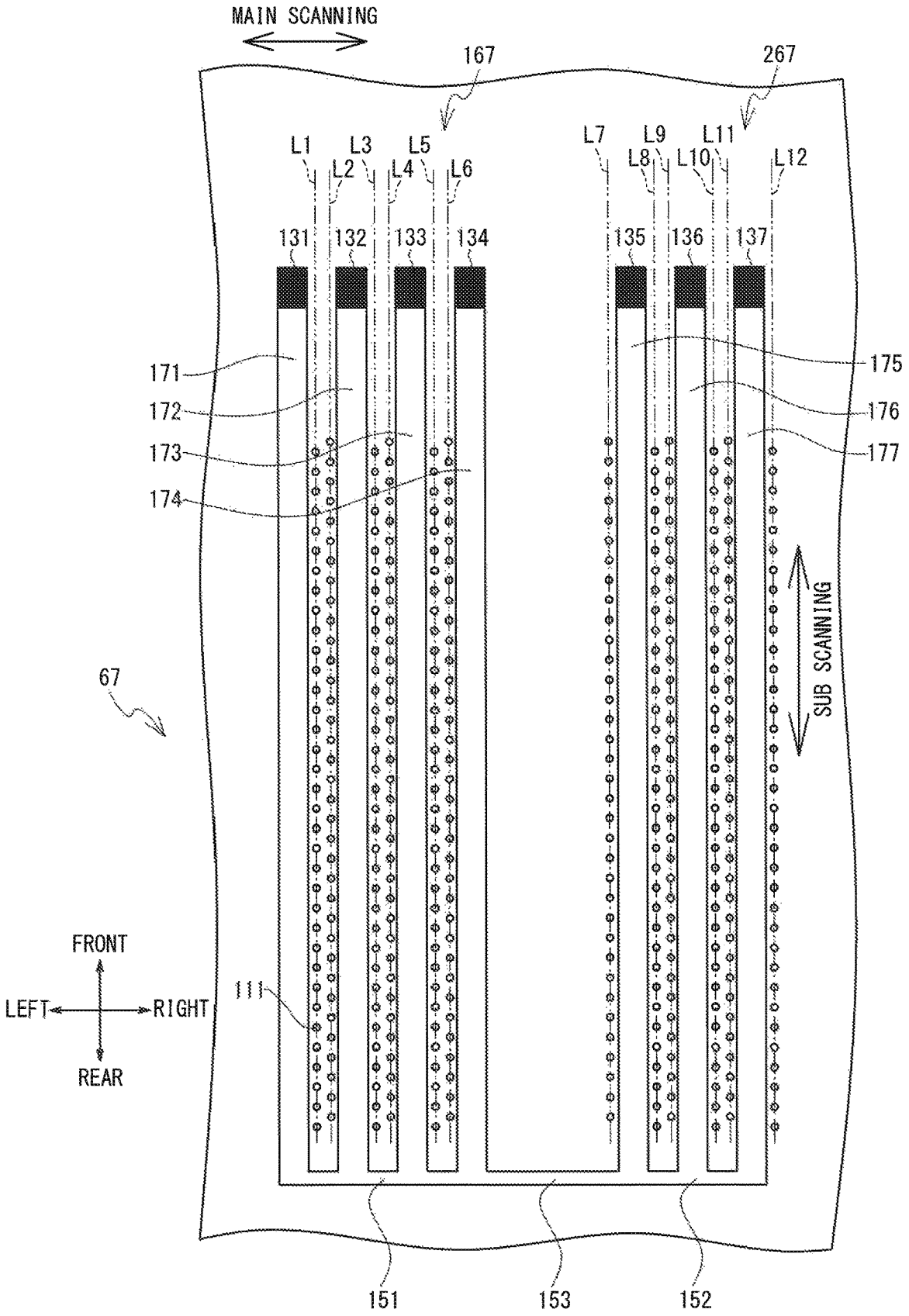
FIG. 4 is a cross-sectional view of a head portion 67.

As shown in FIG. 4, the head portion 67 has the first nozzle portion 167 and the second nozzle portion 267. The first nozzle portion 167 has a plurality of liquid flow paths 171 to 174 and a plurality of nozzle arrays L1 to L6 that are arrayed in a first pattern. The second nozzle portion 267 has a plurality of liquid flow paths 175 to 177 and a plurality of nozzle arrays L7 to L12 that are arrayed in a second pattern. The liquid flow path 171 of the first nozzle portion 167 is communicated with nozzles 111 included in the nozzle array L1. The liquid flow path 172 is communicated with the nozzles 111 included in the nozzle arrays L2 and L3. The liquid flow path 173 is communicated with the nozzles 111 included in the nozzle arrays L4 and L5. The liquid flow path 174 is communicated with the nozzles 111 included in the nozzle array L6. Front end portions of the liquid flow paths 171, 172, 173 and 174 are respectively provided with supply ports 131, 132, 133 and 134. The supply ports 131 to 134 can supply the ink 68 to the liquid flow paths 171 to 174, respectively.

Further, the liquid flow path 175 of the second nozzle portion 267 is communicated with the nozzles 111 included in the nozzle arrays L7 and L8. The liquid flow path 176 is communicated with the nozzles 111 included in the nozzle arrays L9 and L10. The liquid flow path 177 is communicated with the nozzles 111 included in the nozzle arrays L11 and L12. Front end portions of the liquid flow paths 175, 176 and 177 are respectively provided with supply ports 135, 136 and 137. The supply ports 135 to 137 can supply the ink 68 to the liquid flow paths 175 to 177, respectively.

Rear end portions of the liquid flow paths 171 to 174 are provided with a communication path 151, and the communication path 151 connects the rear end portions of the liquid flow paths 171 to 174. Further, rear end portions of the liquid flow paths 175 to 177 are provided with a communication path 152, and the communication path 152 connects the rear end portions of the liquid flow paths 175 to 177. The communication path 151 and the communication path 152 are connected by a communication path 153.

When printing is performed on the recording medium, as described above, the ink 68 is supplied from the supply ports 131 to 137 to the liquid flow paths 171 to 177, respectively, and is ejected from the nozzle arrays L11 to L12. Further, when ink circulation (refer to step S14 in FIG. 6 and step S34 in FIG. 10) to be described later is performed, the ink 68 flows from one side of the first nozzle portion 167 and the second nozzle portion 267 to the other side. For example, the ink 68 flows from the supply ports 131 to 134 to the liquid flow paths 171 to 174, respectively, and further, the ink 68 flows from the communication path 151 to the communication path 152 via the communication path 153. Then, the ink 68 flows from the communication path 152 to the liquid flow paths 175 to 177 and returns to the supply ports 135 to 137. Thus, when the ink circulation processing is performed, the liquid flow paths 171 to 174, the communication path 151, the communication path 153, the communication path 152, and the liquid flow paths 175 to 177 form a circulation flow path of the ink 68 inside the head portion 67. A flow path resistance outside the head portion 67 is smaller than a flow path resistance inside the head portion 67. For example, a cross-sectional area of each of the liquid flow paths 171 to 174, the communication path 151, the communication path 153, the communication path 152, and the liquid flow paths 175 to 177 is smaller than a cross-sectional area of each of the first supply flow path 711, the second supply flow path 712, the first circulation flow path 721, the second circulation flow path 722 and the bypass flow path 801.

From the Hagen-Poiseuille law, the flow path resistance is represented by the following Equation 1.

$$\text{Flow path resistance}=(8\times\rho\times L)/(\pi\times r^4) \qquad \text{Equation 1}$$

r: radius of flow path, ρ: viscosity coefficient of ink 68, L: length of flow path Therefore, as the cross-sectional area ($\pi\times r^2$) becomes smaller, the flow path resistance becomes larger. The cross-sectional area of each of the first supply flow path 711, the second supply flow path 712, the first circulation flow path 721, the second circulation flow path 722 and the bypass flow path 801 is larger than the cross-sectional area of each of the liquid flow paths 171 to 174, the communication path 151, the communication path 153, the communication path 152, and the liquid flow paths 175 to 177. Therefore, the flow path resistance of each of the first supply flow path 711, the second supply flow path 712, the first circulation flow path 721, the second circulation flow path 722 and the bypass flow path 801 is smaller than the flow path resistance of each of the liquid flow paths 171 to 174, the communication path 151, the communication path 153, the communication path 152 and the liquid flow paths 175 to 177. Note that each cross-sectional area is defined by a direction that is perpendicular to the direction in which the ink 68 flows in each of the flow paths.

Further, the pressure of the ink 68 that flows in the flow path is represented by the following Equation 2.

$$\text{Pressure } P=\text{flow path resistance}\times\text{flow rate of the ink } 68 \qquad \text{Equation 2}$$

Further, when the pressure at the entrance of the flow path is denoted by Pin and the pressure at the exit of the flow path is denoted by Pout, a pressure difference ΔP is represented by the following Equation 3.

$$\Delta P=P\text{in}-P\text{out} \qquad \text{Equation 3}$$

When ΔP is a positive value, the meniscus is pushed out from the nozzles 111. Further, when ΔP is a negative value, air bubbles are introduced into the nozzles 111.

Cleaning Liquid Supply Path 90

As shown in FIG. 7, the cleaning liquid supply path 90 is provided with a cleaning liquid tank 32, a supply flow path 110, a drainage flow path 120, a pump 199 and a drainage tank 33. The cleaning liquid tank 32 stores a cleaning liquid 92. The supply flow path 110 connects the cleaning liquid tank 32 and a supply hole 661 of the cap 66, and supplies the cleaning liquid 92 to the inside of the cap 66. Further, the supply flow path 110 is provided with an atmospheric air opening 113, an electromagnetic valve 114 and an electromagnetic valve 115. The electromagnetic valve 114 opens and closes the atmospheric air opening 113. The electromagnetic valve 115 opens and closes the supply flow path 110. The drainage flow path 120 connects an exhaust hole 662 of the cap 66 and the drainage tank 33, and discharges the ink 68 and the cleaning liquid 92 in an inner portion 663 of the cap 66 to the drainage tank 33. The drainage flow path 120 is provided with an electromagnetic valve 121 and the pump 199. The electromagnetic valve 121 opens and closes the drainage flow path 120. The pump 199 sucks in air and the cleaning liquid 92 in the supply flow path 110. Further, the pump 199 sucks in air, the ink 68 and the cleaning liquid 92 in the inner portion 663 of the cap 66, and air, the ink 68 and the cleaning liquid 92 in the drainage flow path 120, and discharges them to the drainage tank 33.

Electrical Configuration of Print Device 1

Figure 5:
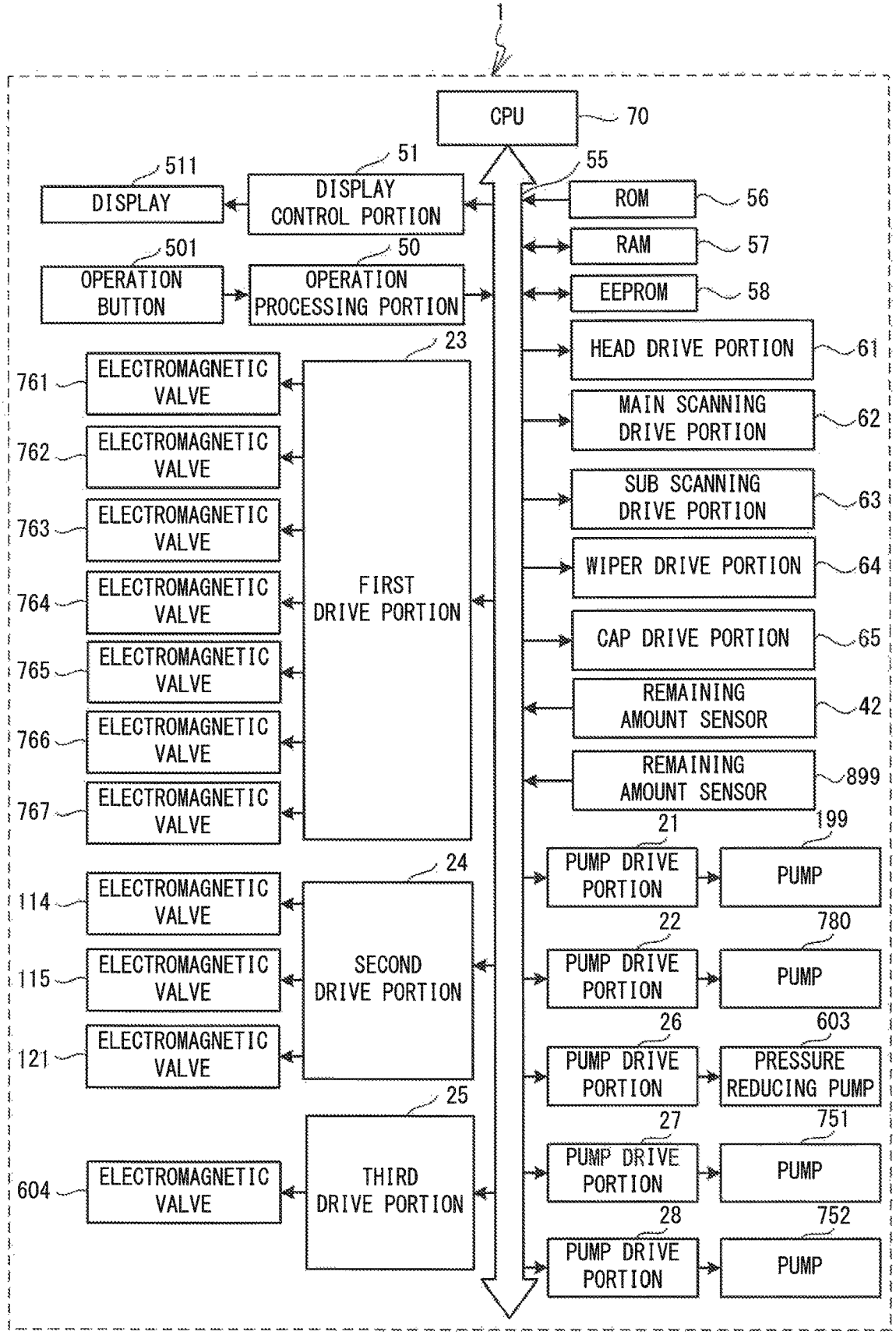
FIG. 5 is a block diagram showing an electrical configuration of the print device 1.

The electrical configuration of the print device 1 will be explained with reference to FIG. 5. The print device 1 is provided with the CPU 70 that controls the print device 1. A ROM 56, a RAM 57, an EEPROM 58, a head drive portion 61, a main scanning drive portion 62, a sub-scanning drive portion 63, a wiper drive portion 64, a cap drive portion 65, the remaining amount sensor 42, the remaining amount sensor 899, a pump drive portion 21, a pump drive portion 22, a pump drive portion 26, a pump drive portion 27, a pump drive portion 28, a display control portion 51, an operation processing portion 50, a first drive portion 23, a second drive portion 24 and a third drive portion 25 are electrically connected to the CPU 70 via a bus 55.

The ROM 56 stores a control program, initial values and the like that are used by the CPU 70 to control operations of the print device 1. The RAM 57 temporarily stores various data that are used in the control program. The EEPROM 58 stores a date and time at which the ink circulation processing (step S14, step S34) to be described later is performed. The head drive portion 61 is electrically connected to the head portion 67 that ejects the ink 68. The head drive portion 61 drives a piezoelectric element that is provided in each of ejection channels of the head portion 67, and causes the ink 68 to be ejected from the nozzles 111.

The main scanning drive portion 62 includes the drive motor 19 (refer to FIG. 1) and causes the carriage 20 to move in the main scanning direction. The sub-scanning drive portion 63 uses a drive motor (not shown in the drawings) to drive the platen drive mechanism 6 (refer to FIG. 1), and causes the platen 5 (refer to FIG. 1) to move in the sub-scanning direction.

The CPU 70 controls the display control portion 51 and displays an image on a display 511. The operation processing portion 50 outputs, to the CPU 70, a signal that is based on an operation of an operation button 501 by a user. The remaining amount sensor 42 outputs, to the CPU 70, a signal indicating a remaining amount of the ink 68 in the main tank 30. The remaining amount sensor 899 outputs, to the CPU 70, a signal indicating a remaining amount of the ink 68 in the sub pouch 8.

The CPU 70 controls the opening and closing of the electromagnetic valves 761 to 767 via the first drive portion 23, and opens and closes the first supply flow path 711, the second supply flow path 712, the first circulation flow path 721, the second circulation flow path 722, the first connection flow path 731 and the second connection flow path 732. The CPU 70 controls the opening and closing of the electromagnetic valves 114, 115 and 121 via the second drive portion 24, and opens and closes the supply flow path 110 (refer to FIG. 7). The CPU 70 controls the pump drive portions 21, 22, 26, 27 and 28 and drives the pump 199, a pump 780, the pressure reducing pump 603, the pump 751 and the pump 752, respectively.

Ink Soaking and Ink Circulation Processing

Ink soaking and ink circulation processing will be explained with reference to FIG. 6 to FIG. 9. In the print device 1, the ink circulation (step S14) is performed at a certain time interval in order to remove air bubbles contained in the ink 68 in the ink flow paths and to eliminate sedimentation of ink components, such as pigments. In this case, if the ink circulation processing (step S14) is performed by increasing a circulation speed of the ink 68 in order to further remove the air bubbles and eliminate the sedimentation of the ink components, there is a possibility that the nozzle meniscus may be damaged. If the meniscus is damaged, in some cases, a failure occurs such that the air bubbles infiltrate from the nozzles into the head or the ink flows out from the nozzles. In the present embodiment, the following ink soaking and ink circulation processing is performed in order to perform the ink circulation processing (step S14) by increasing the circulation speed of the ink 68 while reducing the possibility of the occurrence of the failure. The explanation will be given below.

Figure 7A:
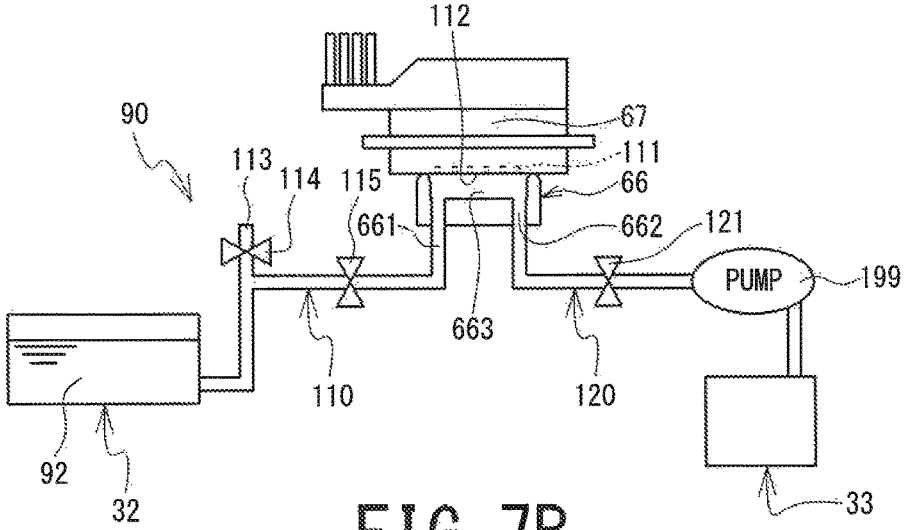
FIG. 7A to FIG. 7C are schematic diagrams showing respective processing steps of the ink soaking and ink circulation processing.

For example, when a power source of the print device 1 is turned on, the CPU 70 reads out, from the ROM 56, a program for main processing (not shown in the drawings) that performs main control of a printing operation etc. of the print device 1, a program for the ink soaking and ink circulation processing, and the like, and loads the programs to the RAM 57. In accordance with the programs, the CPU 70 performs the main processing and the ink soaking and ink circulation processing. Note that, as shown in FIG. 7A, when the printing operation is not performed by the head portion 67 ejecting the ink 68, processing is performed in which the cap 66 comes into contact with the nozzle surface 112 of the head portion 67 and inhibits the nozzles 111 from drying up.

Figure 6:
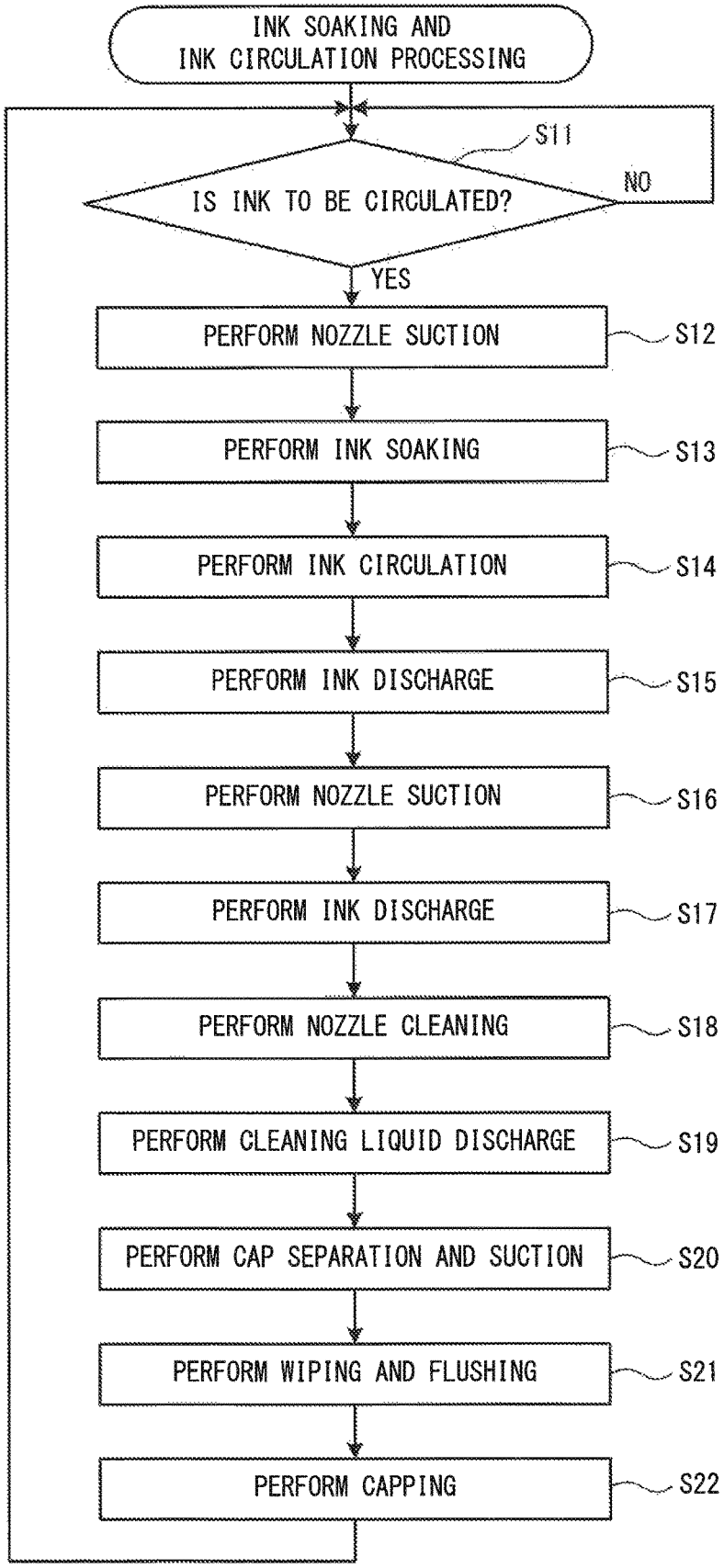
FIG. 6 is a flowchart of ink soaking and ink circulation processing.

As shown in FIG. 6, in the ink soaking and ink circulation processing, first, the CPU 70 determines whether to perform the ink circulation (step S11). For example, when a certain period of time has elapsed from the date and time of the previous ink circulation processing (step S14) stored in the EEPROM 58, the CPU 70 determines that the ink circulation processing is to be performed (yes at step S11). The certain period of time is seven hours, for example. When the CPU 70 determines that the ink circulation processing is not to be performed (no at step S11), the CPU 70 repeats the processing at step S11.

Figure 7B:
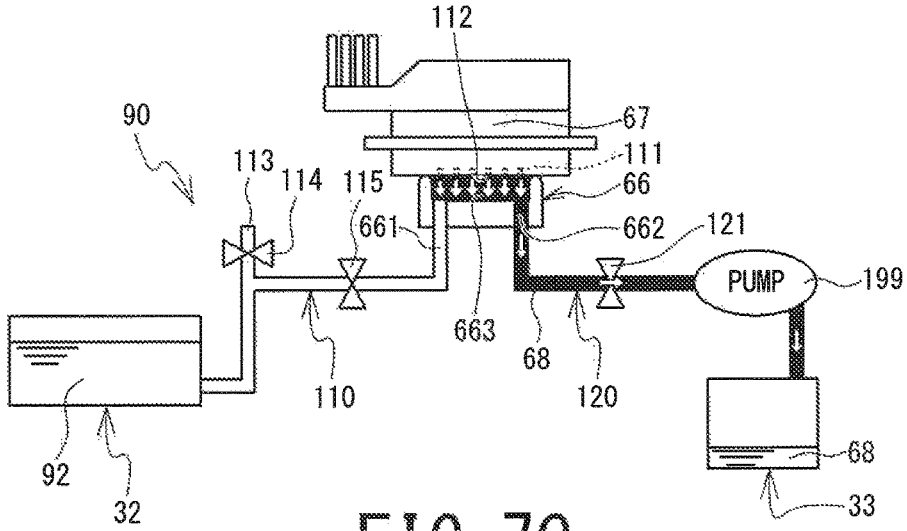
Figure 7C:
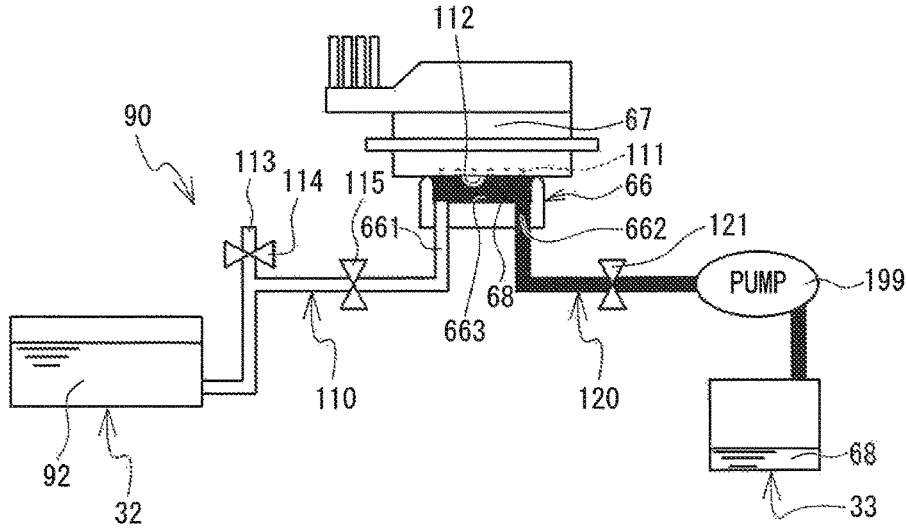

When the CPU 70 determines that the ink circulation is to be performed (yes at step S11), the CPU 70 performs nozzle suction (step S12). For example, as shown in FIG. 7B, the CPU 70 closes the electromagnetic valve 115, opens the electromagnetic valve 121, and drives the pump 199. Note that the electromagnetic valve 114 may be closed or remain open. Thus, the ink 68 is sucked in from the nozzles 111 of the head portion 67. Then, the CPU 70 performs ink soaking (step S13). For example, as shown in FIG. 7C, the CPU 70 drives the pump 199 for a certain period of time and fills the inner portion 663 of the cap 66 with the ink 68. In a state in which the nozzle surface 112 is soaked in the ink 68, the CPU 70 stops the pump 199 and closes the electromagnetic valve 121.

Next, the CPU 70 performs the ink circulation (step S14). For example, as shown in FIG. 3, when the circulation is performed between the head portion 67 and the bypass flow path 801, the CPU 70 opens the electromagnetic valve 767 and closes the electromagnetic valves 763 and 766. Next, the CPU 70 drives the pump 752. Thus, as shown in FIG. 3, the circulation of the ink 68 is performed in the second supply flow path 712, the head portion 67, the second circulation flow path 722 and the bypass flow path 801 (refer to arrows 491). As shown in FIG. 4, inside the head portion 67, the ink 68 circulates in an order of the liquid flow paths 171 to 174, the communication path 151, the communication path 153, the communication path 152 and the liquid flow paths 175 to 177. Thus, in the state in which the nozzle surface 112 is soaked in the ink 68, the circulation of the ink 68 is performed in the second supply flow path 712, the head portion 67, the second circulation flow path 722 and the bypass flow path 801 (refer to the arrows 491). Further, the CPU 70 stores, in the EEPROM 58, the date and time at which the ink circulation is performed.

Figure 8A:
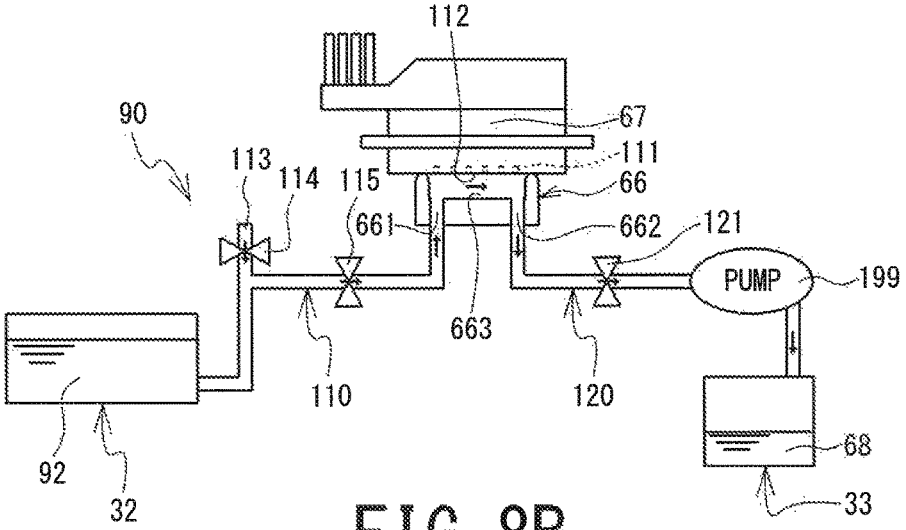
FIG. 8A to FIG. 8C are schematic diagrams showing respective processing steps of the ink soaking and ink circulation processing.

Next, the CPU 70 performs ink discharge (step S15). For example, as shown in FIG. 8A, the CPU 70 opens the electromagnetic valves 114 and 115 and opens the atmospheric air opening 113, thus causing the inner portion 663 of the cap 66 to be in an atmospheric air communication state. Further, the CPU 70 opens the electromagnetic valve 121 and drives the pump 199. Therefore, the ink 68 which has been discharged from the nozzles 111 to the inner portion 663 of the cap 66 and which contains dirt from the inner portion 663 of the cap 66 is discharged from the exhaust hole 662 to the drainage tank 33 via the drainage flow path 120.

Figure 8B:
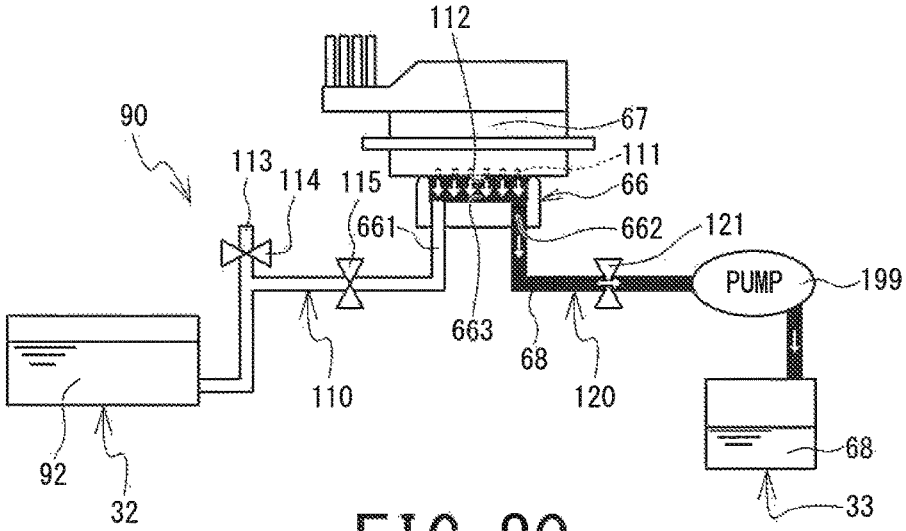
Figure 8C:
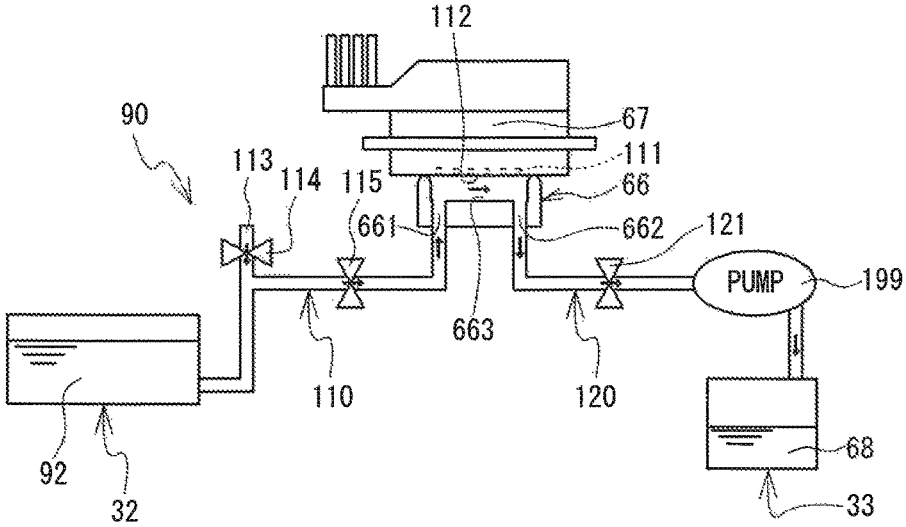

Next, the CPU 70 performs nozzle suction (step S16). For example, as shown in FIG. 8B, in a capping state in which the cap 66 is in contact with the nozzle surface 112, the CPU 70 closes the electromagnetic valve 115 and causes the inner portion 663 of the cap 66 to be in an atmospheric air non-communication state. Then, the CPU 70 opens the electromagnetic valve 121, drives the pump 199, and sucks in the ink 68 from the nozzles 111. Note that the electromagnetic valve 114 may be closed or remain open. Thus, the ink 68 containing the dirt that has entered into the nozzles 111 at the time of the ink soaking, is discharged. Next, as shown in FIG. 8C, the CPU 70 performs ink discharge (step S17). The ink discharge (step S17) is the same processing as the above-described ink discharge (step S15), and an explanation thereof is thus omitted here.

Figure 9A:
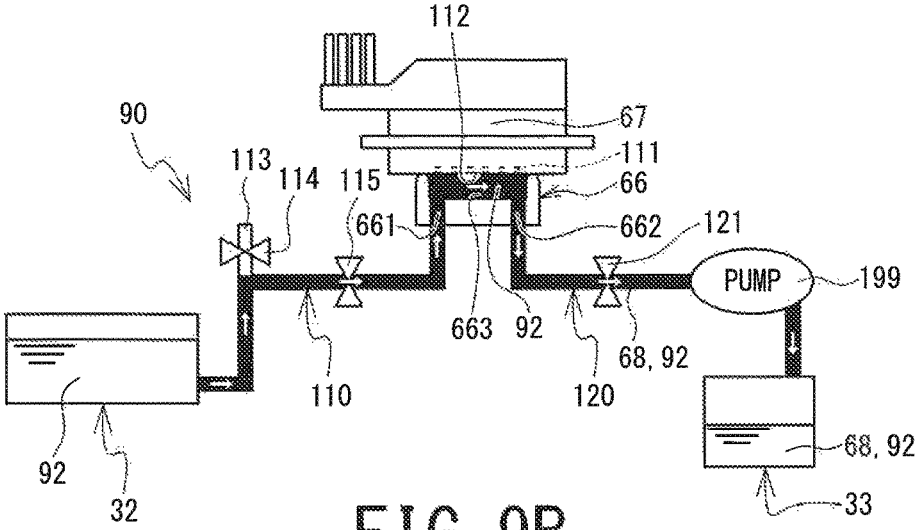
FIG. 9A to FIG. 9C are schematic diagrams showing respective processing steps of the ink soaking and ink circulation processing.

Next, as shown in FIG. 9A, the CPU 70 performs nozzle cleaning (step S18). For example, the CPU 70 closes the electromagnetic valve 114, opens the electromagnetic valves 115 and 121, and drives the pump 199, thus filling the inner portion 663 of the cap 66 with the cleaning liquid 92 in the cleaning liquid tank 32 via the supply flow path 110. At this time, the nozzle surface 112 is soaked in the cleaning liquid 92 to clean the nozzle surface 112.

Figure 9B:
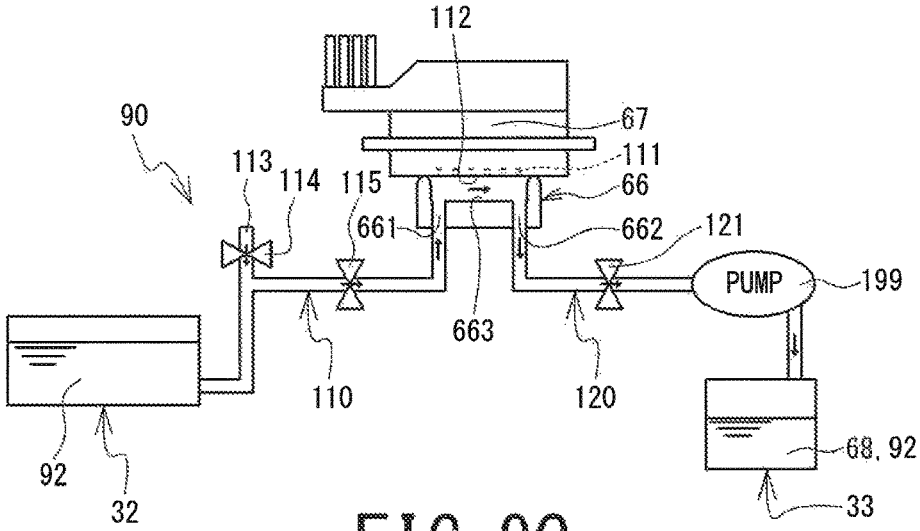

Next, the CPU 70 performs discharge of the cleaning liquid 92 (step S19). For example, as shown in FIG. 9B, the CPU 70 opens the electromagnetic valves 114 and 115, opens the atmospheric air opening 113, and causes the inner portion 663 of the cap 66 to be in the atmospheric air communication state. Further, the CPU 70 opens the electromagnetic valve 121 and drives the pump 199. Thus, the cleaning liquid 92, which is filled in the inner portion 663 of the cap 66 and which contains dirt, is discharged from the exhaust hole 662 to the drainage tank 33 via the drainage flow path 120.

Figure 9C:
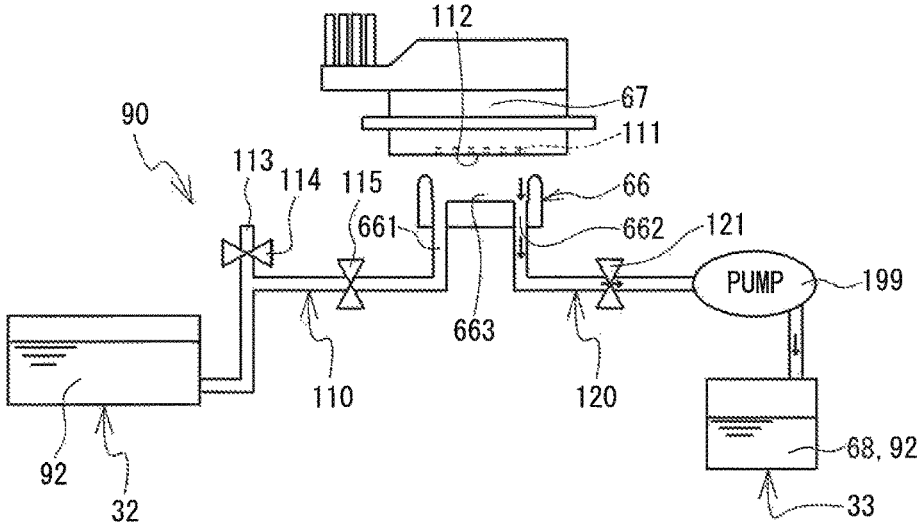

Next, the CPU 70 performs separation and suction of the cap 66 (step S20). For example, as shown in FIG. 9C, the CPU 70 controls the cap drive portion 65 (refer to FIG. 5) and causes the cap 66 to separate from the nozzle surface 112. At the same time, the CPU 70 opens the electromagnetic valves 114, 115 and 121 and drives the pump 199. As a result, the cleaning liquid 92 containing the dirt and remaining in the inner portion 663 of the cap 66 and the drainage flow path 120 is discharged to the drainage tank 33.

Next, the CPU 70 performs wiping and flushing (step S21). First, the CPU 70 causes the wiper 36 to come into contact with the nozzle surface 112 by controlling the wiper drive portion 64, and causes the wiper 36 to wipe off the cleaning liquid 92 and the ink 68 remaining on the nozzle surface 112. Then, the CPU 70 performs flushing. For example, the CPU 70 causes the main scanning drive portion 62 to move the head portion 67 onto the flushing receiving portion 145 (refer to FIG. 2), and causes the flushing receiving portion 145 (refer to FIG. 2) to eject the ink 68 from the nozzles 111. As a result of performing the flushing, the nozzle meniscus is adjusted and the ink 68 is appropriately ejected from the nozzles 111.

Next, as shown in FIG. 7A, the CPU 70 performs capping (step S22). For example, the CPU 70 controls the cap drive portion 65 (refer to FIG. 5) and causes the cap 66 to come into contact with the nozzle surface 112, thus covering the nozzles 111. Then, the CPU 70 returns the processing to step S11.

Operations and Effects of First Embodiment

As explained above, in the print device 1 of the first embodiment, in the state in which the nozzle surface 112 is soaked in the ink 68, the circulation of the ink 68 is performed in the second supply flow path 712, the head portion 67, the second circulation flow path 722 and the bypass flow path 801 (refer to the arrows 491). It is therefore possible to reduce the possibility of introducing air bubbles from the nozzles 111 into the head portion 67. Further, it is possible to reduce the possibility of flow out of the ink 68 from the nozzles 111. Therefore, the ink 68 can be circulated by increasing the circulation speed of the ink 68 in the circulation flow path of the ink 68.

Further, when the ink circulation (step S14) is performed, as shown in FIG. 7C, the nozzle surface 112 is soaked in the ink 68. In this state, inside the head portion 67, the ink 68 circulates in the order of the liquid flow paths 171 to 174, the communication path 151, the communication path 153, the communication path 152 and the liquid flow paths 175 to 177. Thus, when the ink 68 circulates in the circulation flow path inside the head portion 67, it is possible to reduce the possibility of introducing air bubbles from the nozzles 111 into the head portion 67. Further, it is possible to reduce the possibility of flow out of the ink 68 from the nozzles 111.

After the ink circulation (step S14), the ink 68 which has been discharged from the nozzles 111 to the inner portion 663 of the cap 66 and which contains the dirt of the inner portion 663 of the cap 66 is discharged from the exhaust hole 662 by the ink discharge (step S15). It is therefore possible to reduce a possibility that the ink 68 containing the dirt may infiltrate into the nozzles 111.

After the ink discharge (step S15), in the capping state in which the cap 66 is in contact with the nozzle surface 112, the CPU 70 causes the inner portion 663 of the cap 66 to be in the atmospheric air non-communication state. Then, the CPU 70 opens the electromagnetic valve 121, drives the pump 199, and performs the nozzle suction (step S16) that sucks in the ink 68 from the nozzles 111. It is therefore possible to discharge the ink 68 containing the dirt, which has entered into the nozzles 111 at the time of the ink soaking (step S13). Thus, it is possible to inhibit a deterioration in quality of the ink 68 in the nozzles 111.

After the ink discharge (step S15), the CPU 70 causes the wiper 36 to come into contact with the nozzle surface 112 and causes the wiper 36 to wipe off the cleaning liquid 92 and the ink 68 remaining on the nozzle surface 112 (step S21). It is thus possible to adjust the meniscus of the nozzles 111.

Before the ink soaking (step S13), the CPU 70 causes the inner portion 663 of the cap 66 to be in the atmospheric air non-communication state. Then, the CPU 70 drives the pump 199, and performs the nozzle suction (step S12) in order to discharge the ink 68 from the nozzles 111. Therefore, the ink 68 precipitated in the head portion 67 can be discharged from the nozzles 111 in advance, and the effect of the circulation of the ink 68 can be enhanced.

In the print device 1 of the first embodiment, the soaking (step S13) is performed using the ink 68. Therefore, even when the ink 68 infiltrates into the nozzles 111, adverse effects are unlikely to occur.

Second Embodiment

Next, a second embodiment will be explained. The second embodiment is the same as the first embodiment in the mechanical configuration and the electrical configuration of the print device 1. The second embodiment differs in that cleaning liquid soaking and ink circulation processing is performed instead of the ink soaking and ink circulation processing. The cleaning liquid soaking and ink circulation processing will be explained with reference to FIG. 10 and FIG. 11.

For example, when the power source of the print device 1 is turned on, the CPU 70 reads out, from the ROM 56, the program for the main processing (not shown in the drawings) that performs main control of the printing operation and the like of the print device 1, a program for the cleaning liquid soaking and ink circulation processing, and the like, and loads the programs to the RAM 57. In accordance with the programs, the CPU 70 performs the main processing and the cleaning liquid soaking and ink circulation processing. Note that, as shown in FIG. 7A, when the printing operation is not performed by the head portion 67 ejecting the ink 68, the cap 66 comes into contact with the nozzle surface 112 of the head portion 67 and inhibits the nozzles 111 from drying up.

Figure 10:
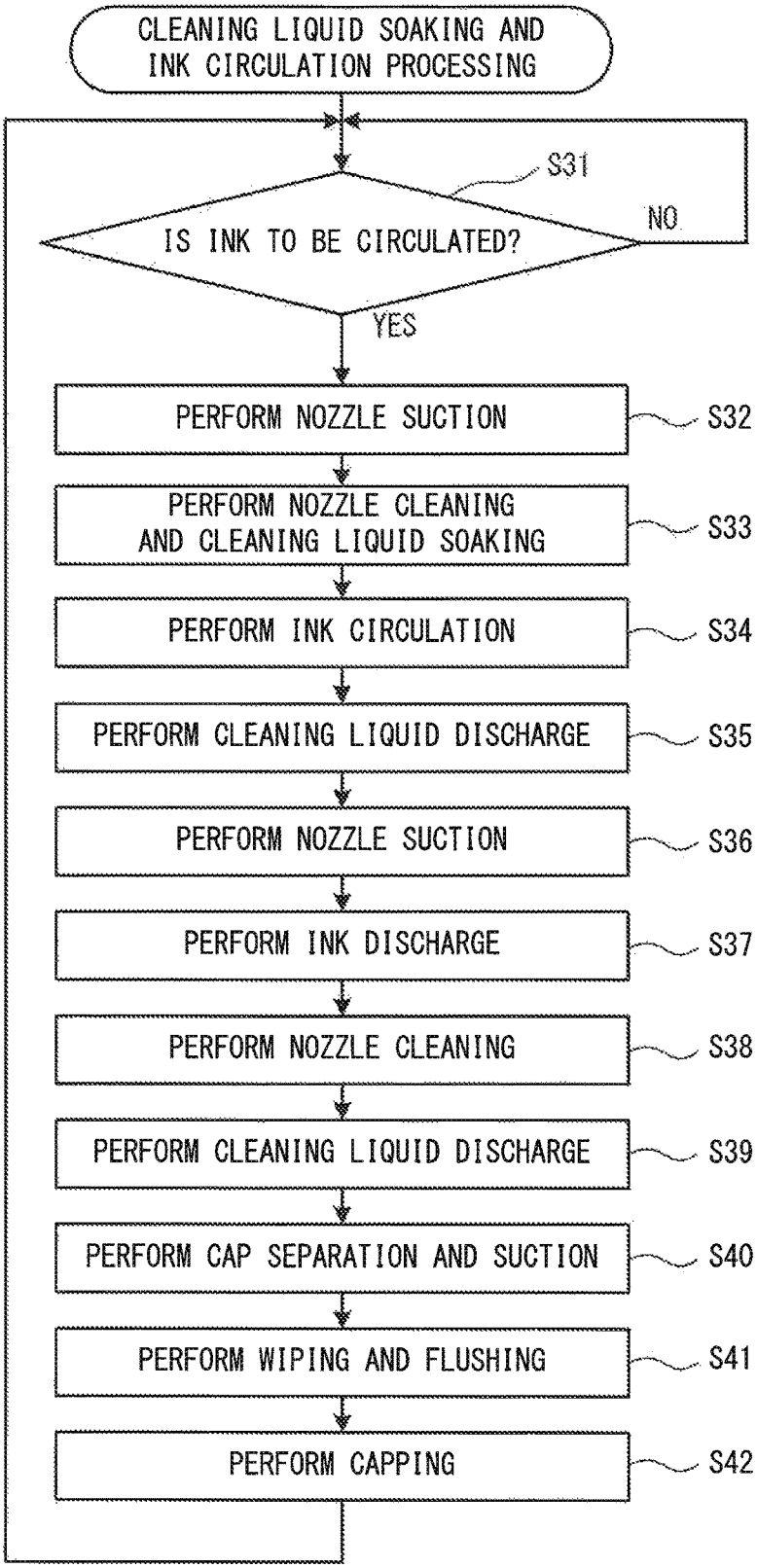
FIG. 10 is a flowchart of cleaning liquid soaking and ink circulation processing.

As shown in FIG. 10, in the cleaning liquid soaking and ink circulation processing, first, the CPU 70 determines whether to perform ink circulation (step S31). The determination processing at step S31 is the same as the determination processing at step S11 of the ink soaking and ink circulation processing, and an explanation thereof is thus omitted here.

Figure 11A:
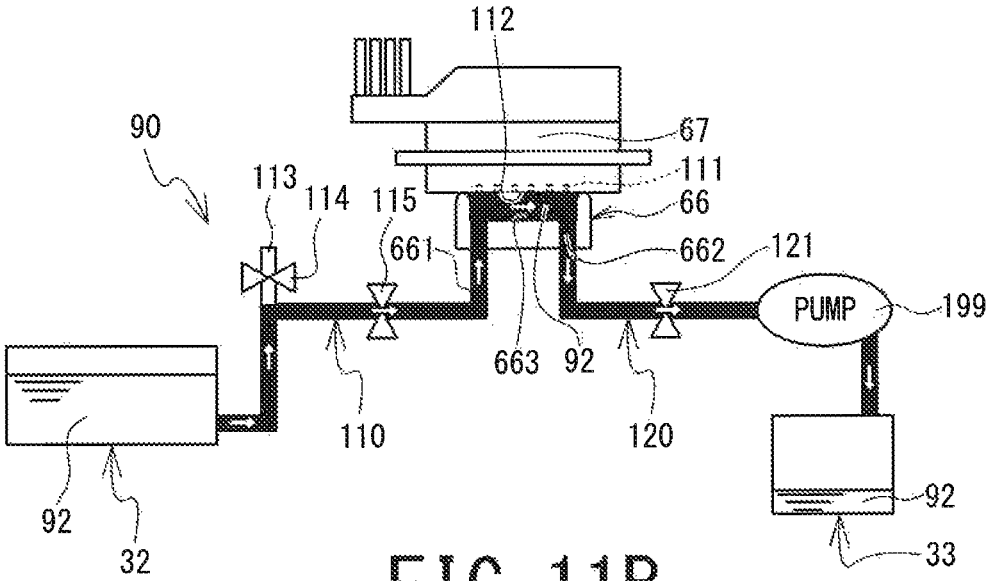
FIG. 11A and FIG. 11B are schematic diagrams showing respective processing steps of the cleaning liquid soaking and ink circulation processing.
Figure 11B:
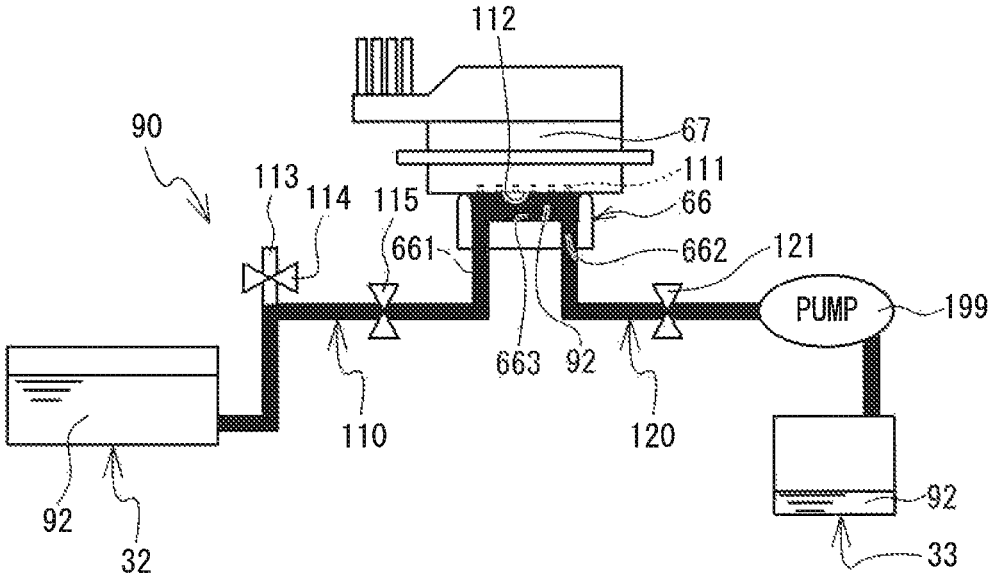

When the CPU 70 determines that the ink circulation is to be performed (yes at step S31), the CPU 70 performs nozzle suction (step S32). The nozzle suction (step S32) is the same processing as the nozzle suction (step S12) of the ink soaking and ink circulation processing shown in FIG. 7B, and an explanation thereof is thus omitted here. Next, the CPU 70 performs nozzle cleaning and cleaning liquid soaking (step S33). For example, as shown in FIG. 11A, the CPU 70 closes the electromagnetic valve 114, opens the electromagnetic valves 115 and 121, and drives the pump 199, thus filling the inner portion 663 of the cap 663 with the cleaning liquid 92 in the cleaning liquid tank 32 via the supply flow path 110. At this time, the nozzle surface 112 is soaked in the cleaning liquid 92 to clean the nozzle surface 112. Next, as shown in FIG. 11B, the CPU 70 stops the pump 199, closes the electromagnetic valves 115 and 121, and maintains the state in which the nozzle surface 112 is soaked in the cleaning liquid 92.

Next, the CPU 70 performs ink circulation (step S34). The ink circulation (step S34) is the same processing as the ink circulation (step S14) of the ink soaking and ink circulation processing, and an explanation thereof is thus omitted here. Next, the CPU 70 performs cleaning liquid discharge (step S35). The cleaning liquid discharge (step S35) is the same processing as the cleaning liquid discharge (step S19) shown in FIG. 9B, and an explanation thereof is thus omitted here. Next, the CPU 70 performs nozzle suction (step S36), ink discharge (step S37), nozzle cleaning (step S38), cleaning liquid discharge (step S39), cap separation and suction (step S40), wiping and flushing (step S41), and capping (step S42). The processing of the nozzle suction (step S36) to the capping (step S42) is the same as the processing of each of the nozzle suction (step S16), the ink discharge (step S17), the nozzle cleaning (step S18), the cleaning liquid discharge (step S19), the cap separation and suction (step S20), the wiping and flushing (step S21), and the capping (step S22) of the ink soaking and ink circulation processing, and an explanation thereof is thus omitted here.

Operations and Effects of Second Embodiment

As explained above, in the print device 1 of the second embodiment, in the state in which the nozzle surface 112 is soaked in the cleaning liquid 92, the circulation of the ink 68 is performed in the second supply flow path 712, the head portion 67, the second circulation flow path 722 and the bypass flow path 801 (refer to the arrows 491). It is therefore possible to reduce the possibility of introducing air bubbles from the nozzles 111 into the head portion 67. Further, it is possible to reduce the possibility of flow out of the ink 68 from the nozzles 111. Thus, the ink 68 can be circulated by increasing the circulation speed of the ink 68 in the circulation flow path of the ink 68.

Further, when the ink circulation (step S34) is performed, as shown in FIG. 11B, the nozzle surface 112 is soaked in the cleaning liquid 92. In this state, inside the head portion 67, the ink 68 circulates in the order of the liquid flow paths 171 to 174, the communication path 151, the communication path 153, the communication path 152 and the liquid flow paths 175 to 177. Thus, when the ink 68 circulates in the circulation flow path inside the head portion 67, it is possible to reduce the possibility of introducing air bubbles from the nozzles 111 into the head portion 67. Further, it is possible to reduce the possibility of flow out of the ink 68 from the nozzles 111.

After the ink circulation (step S34), the cleaning liquid 92 containing the dirt of the inner portion 663 of the cap 66 is discharged from the exhaust hole 662 by the cleaning liquid discharge (step S35). It is therefore possible to reduce the possibility that the cleaning liquid 92 containing the dirt may infiltrate into the nozzles 111.

After the cleaning liquid discharge (step S35), in the capping state in which the cap 66 is in contact with the nozzle surface 112, the CPU 70 causes the inner portion 663 of the cap 66 to be in the atmospheric air non-communication state. Then, the CPU 70 opens the electromagnetic valve 121, drives the pump 199, and performs the nozzle suction (step S36) that sucks in the ink 68 from the nozzles 111. It is therefore possible to discharge the cleaning liquid 92 containing the dirt, which has entered into the nozzles 111 at the time of the cleaning liquid soaking (step S33). Thus, it is possible to inhibit the deterioration in the quality of the ink 68 in the nozzles 111.

After the cleaning liquid discharge (step S35), the CPU 70 causes the wiper 36 to come into contact with the nozzle surface 112 and causes the wiper 36 to wipe off the cleaning liquid 92 and the ink 68 remaining on the nozzle surface 112 (step S41). It is therefore possible to adjust the meniscus of the nozzles 111.

Before the nozzle cleaning and cleaning liquid soaking (step S33), the CPU 70 causes the inner portion 663 of the cap 66 to be in the atmospheric air non-communication state. Then, the CPU 70 drives the pump 199, and performs the nozzle suction (step S32) that sucks in the ink 68 from the nozzles 111. Therefore, the ink 68 precipitated in the head portion 67 can be discharged from the nozzles 111 in advance, and the effect of the circulation of the ink 68 can be enhanced.

Further, as described above, the cross-sectional area of each of the liquid flow paths 171 to 174, the communication path 151, the communication path 153, the communication path 152, and the liquid flow paths 175 to 177 is smaller than the cross-sectional area of each of the first supply flow path 711, the second supply flow path 712, the first circulation flow path 721 and the second circulation flow path 722. Therefore, the flow path resistance of each of the first supply flow path 711, the second supply flow path 712, the first circulation flow path 721 and the second circulation flow path 722 is smaller than the flow path resistance of each of the liquid flow paths 171 to 174, the communication path 151, the communication path 153, the communication path 152 and the liquid flow paths 175 to 177. It is therefore possible to reduce the possibility that the ink 68 and the cleaning liquid 92 containing dirt may infiltrate from the nozzles 111.

Figure 12:
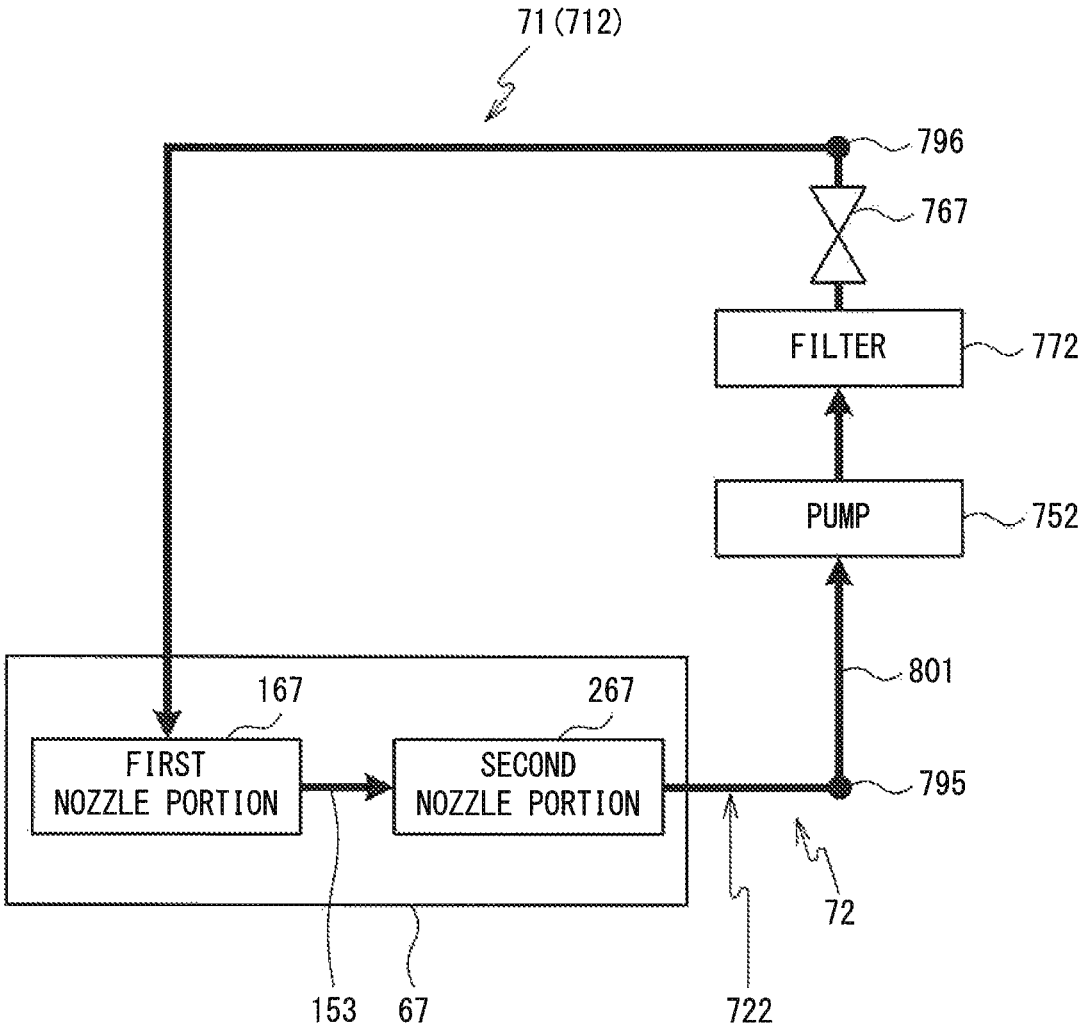
FIG. 12 is a diagram schematically showing a configuration of a circulation flow path of an ink 68 between the head portion 67 and a bypass flow path 801.

Next, the flow path resistance of the circulation flow path will be explained with reference to FIG. 12. FIG. 12 is a diagram schematically showing the configuration of the circulation flow path of the ink 68 between the head portion 67 and the bypass flow path 801 shown in FIG. 3. In the circulation flow path shown in FIG. 12, the second supply flow path 712 is referred to as an outward path 71. Further, the second circulation flow path 722 and the bypass flow path 801 are referred to as a return path 72. The outward path 71 is a flow path extending from the pump 752 toward the first nozzle portion 167 of the head portion 67. The return path 72 is a flow path extending from the second nozzle portion 267 toward the pump 752 via the second circulation flow path 722 and the bypass flow path 801. The outward path 71 is provided with the filter 772 that increases the flow path resistance of the outward path 71 to be larger than the flow path resistance of the return path 72. As a result, the pressure of the ink 68 flowing through the outward path 71 becomes smaller than the pressure of the ink 68 flowing through the return path 72. Thus, the pressure of the ink 68 in the first nozzle portion 167 and the second nozzle portion 267 becomes negative. It is thus possible to increase adhesion of the cap 66 to the nozzle surface 112.

Note that the present invention is not limited to the above-described embodiments and various modifications are possible. For example, in the first embodiment and the second embodiment described above, the ink circulation in the processing at step S14 and step S34 is the circulation between the head portion 67 and the bypass flow path 801. However, the ink circulation is not limited to this example. For example, the ink circulation may be circulation between the head portion 67 and the main tank 30. When the circulation between the head portion 67 and the main tank 30 is performed, the CPU 70 opens the electromagnetic valves 761, 763, 764 and 766, and closes the electromagnetic valves 762 and 765. Then, the CPU 70 drives the pump 751. Thus, the ink 68 is sucked up from the main tank 30, and flows to the main tank 30 via the first supply flow path 711, the second supply flow path 712, the head portion 67, the second circulation flow path 722 and the first circulation flow path 721. In this case also, the circulation of the ink 68 (step S14, step S34) is performed in the state in which the nozzle surface 112 is soaked in the ink 68 or the nozzle surface 112 is soaked in the cleaning liquid 92. It is therefore possible to reduce the possibility of introducing air bubbles from the nozzles 111 into the head portion 67. Further, it is possible to reduce the possibility of flow out of the ink 68 from the nozzles 111. Thus, the ink 68 can be circulated by increasing the circulation speed of the ink 68 in the circulation between the head portion 67 and the main tank 30.

Further, the ink circulation may be circulation of the ink 68 between the sub pouch 8 and the main tank 30. For example, the CPU 70 opens the electromagnetic valves 761, 762, 765 and 764. Then, the CPU 70 drives the pump 751. Therefore, the ink 68 is sucked up from the main tank 30, and flows to the main tank 30 via the first supply flow path 711, the sub pouch 8 and the first circulation flow path 721. In this case also, the circulation of the ink 68 (step S14, step S34) is performed in the state in which the nozzle surface 112 is soaked in the ink 68 or the nozzle surface 112 is soaked in the cleaning liquid 92. Therefore, even when pressure fluctuations of the ink 68 that circulates between the sub pouch 8 and the main tank 30 are transmitted to the head portion 67 side via the second supply flow path 712 and the second circulation flow path 722, it is possible to reduce the possibility of introducing air bubbles from the nozzles 111 into the head portion 67. Further, it is possible to reduce the possibility of flow out of the ink 68 from the nozzles 111. Thus, the ink 68 can be circulated by increasing the circulation speed of the ink 68 in the circulation between the sub pouch 8 and the main tank 30.

Further, the ink circulation at step S14 and step S34 may be circulation between the sub pouch 8 and the bypass flow path 801. For example, the CPU 70 opens the electromagnetic valves 762, 763, 767, 766 and 765, and closes the electromagnetic valves 761 and 764. Then, the CPU 70 drives the pump 752. As a result, the ink 68 circulates in an order of the sub pouch 8, the second supply flow path 712, the bypass flow path 801, the second circulation flow path 722 and the sub pouch 8. In this case also, the circulation of the ink 68 (step S14, step S34) is performed in the state in which the nozzle surface 112 is soaked in the ink 68 or the nozzle surface 112 is soaked in the cleaning liquid 92. Therefore, even when pressure fluctuations of the ink 68 that circulates between the sub pouch 8 and the bypass flow path 801 are transmitted to the head portion 67 side via the second supply flow path 712 and the second circulation flow path 722, it is possible to reduce the possibility of introducing air bubbles from the nozzles 111 into the head portion 67. Further, it is possible to reduce the possibility of flow out of the ink 68 from the nozzles 111. Thus, the ink 68 can be circulated by increasing the circulation speed of the ink 68 in the circulation between the sub pouch 8 and the bypass flow path 801.

Further, the ink circulation in the processing at step S14 and step S34 may be circulation of the ink 68 between the bypass flow path 801 and the main tank 30. For example, the CPU 70 opens the electromagnetic valves 761, 763, 767, 766 and 764, and closes the electromagnetic valves 762 and 765. Then, the CPU 70 drives the pumps 751 and 752. As a result, the ink 68 is sucked up from the main tank 30, and flows to the main tank 30 via the first supply flow path 711, the second supply flow path 712, the bypass flow path 801, the second circulation flow path 722 and the first circulation flow path 721. In this case also, the circulation of the ink 68 (step S14, step S34) is performed in the state in which the nozzle surface 112 is soaked in the ink 68 or the nozzle surface 112 is soaked in the cleaning liquid 92. Therefore, even when pressure fluctuations of the ink 68 that circulates between the bypass flow path 801 and the main tank 30 are transmitted to the head portion 67 side via the second supply flow path 712 and the second circulation flow path 722, it is possible to reduce the possibility of introducing air bubbles from the nozzles 111 into the head portion 67. Further, it is possible to reduce the possibility of flow out of the ink 68 from the nozzles 111. Thus, the ink 68 can be circulated by increasing the circulation speed of the ink 68 in the circulation between the bypass flow path 801 and the main tank 30.

Further, in the cleaning liquid soaking and ink circulation processing shown in FIG. 10, the nozzle suction (step S32) need not necessarily be performed. Further, the configuration of the supply flow path and the circulation flow path of the ink 68 is not limited to that of the above-described embodiments. The configuration of the supply flow path 110 and the drainage flow path 120 of the cleaning liquid 92 is not limited to that of the above-described embodiments. Further, a cartridge may be used as the storage portion of the ink 68, in place of the main tank 30. Further, the sub pouch 8 need not necessarily be provided. Furthermore, the configuration of the ink flow path inside the head portion 67 is not limited to that shown in FIG. 4. Furthermore, the resistance member is not limited to the filter 772, and the flow path resistance may be increased by reducing the cross-sectional area of the flow path.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An inkjet printer comprising:

a head provided with a nozzle surface having nozzles configured to eject an ink;

a storage configured to store ink;

a supply flow path configured to connect the head and the storage;

a circulation flow path configured to circulate the ink;

a cap capable of coming into contact with the nozzle surface;

a first pump connected to an exhaust hole formed in the cap;

a processor; and a memory storing computer-readable instructions which, when executed by the processor, perform processes including:

a soaking processing that drives the first pump and causes the nozzle surface to be soaked in liquid, in a capping state in which the cap is in contact with the nozzle surface, and a circulation processing that causes the ink to circulate in the circulation flow path in a state in which the nozzle surface is soaked in the liquid, after the soaking processing, the circulation flow path, in which the ink is circulated before ejected from the nozzles provided on the nozzle surface, being connected to any one of the storage, the supply flow path, and the head.

2. The inkjet printer according to claim 1, wherein the circulation flow path is formed in the head.

3. The inkjet printer according to claim 1, wherein after the circulation processing, the processor causes the inside of the cap to be in an atmospheric air communication state, drives the first pump, and performs a discharge processing that discharges the liquid in the cap from the exhaust hole.

4. The inkjet printer according to claim 3, wherein after the discharge processing, in the capping state, the processor performs a first suction purge processing that causes the inside of the cap to be in an atmospheric air non-communication state, drives the first pump, and discharges the ink from the nozzles.

5. The inkjet printer according to claim 3, further comprising a wiper configured to come into contact with the nozzle surface and move relative to the nozzle surface, wherein the processor performs a wiping processing that moves the wiper relative to the nozzle surface, after the discharge processing.

6. The inkjet printer according to claim 1, wherein before the soaking processing, the processor performs a second suction purge processing that drives the first pump in the capping state and discharges the ink from the nozzles.

7. The inkjet printer according to claim 1, wherein a flow path resistance of the circulation flow path is smaller than a flow path resistance of the nozzles.

8. The inkjet printer according to claim 1, further comprising:

a second pump provided in the circulation flow path and configured to circulate the ink;

an outward path provided in the circulation flow path and extending from the second pump toward the nozzles;

a return path provided in the circulation flow path and extending from the nozzles toward the second pump; and a resistance member provided in the outward path and configured to increase a flow path resistance of the outward path to be larger than a flow path resistance of the return path, and to cause a pressure of the ink in the nozzles to be negative.

9. The inkjet printer according to claim 1, wherein the liquid is the ink, and in the soaking processing, the processor drives the first pump in the capping state and causes the nozzle surface to be soaked in the ink.

10. A control method of an inkjet printer that includes:

a head provided with a nozzle surface having inkjet nozzles configured to eject an ink;

a storage configured to store ink;

a supply flow path configured to connect the head and the storage;

a circulation flow path configured to circulate the ink;

a cap capable of coming into contact with the nozzle surface; and a first pump connected to an exhaust hole formed in the cap, the control method comprising:

a soaking step of driving the first pump and causing the nozzle surface to be soaked in liquid, in a capping state in which the cap is in contact with the nozzle surface; and a circulation step of causing the ink to circulate in the circulation flow path in a state in which the nozzle surface is soaked in the liquid, after the soaking step, the circulation flow path, in which the ink is circulated before ejected from the nozzles provided on the nozzle surface, being connected to any one of the storage, the supply flow path, and the head.

11. A non-transitory computer-readable medium storing computer-readable instructions that, when executed by a processor of an inkjet printer comprising a head provided with a nozzle surface having inkjet nozzles configured to eject an ink, a storage configured to store ink, a supply flow path configured to connect the head and the storage, a circulation flow path configured to circulate the ink, a cap capable of coming into contact with the nozzle surface, a first pump connected to an exhaust hole formed in the cap, and the processor, perform processes comprising:

a soaking processing that drives the first pump and causes the nozzle surface to be soaked in liquid, in a capping state in which the cap is in contact with the nozzle surface; and a circulation processing that causes the ink to circulate in the circulation flow path in a state in which the nozzle surface is soaked in the liquid, after the soaking processing, the circulation flow path, in which the ink is circulated before ejected from the nozzles provided on the nozzle surface, being connected to any one of the storage, the supply flow path, and the head.

* * * * *